United States Patent [19]

Ditty et al.

[11] Patent Number: 4,876,787

[45] Date of Patent: Oct. 31, 1989

[54] APPARATUS AND METHOD FOR FRAME WALL FABRICATION

[75] Inventors: Jeffrey L. Ditty, P.O. Box 55128, Lexington, Ky. 40555; Robert L. Rives, Lexington, Ky.; James T. Schanding, Paris, Ky.; Eric S. Burka, Lexington, Ky.

[73] Assignees: Jeffrey L. Ditty; Versa Tech Engineering, both of Lexington, Ky.

[21] Appl. No.: 208,686

[22] Filed: Jun. 20, 1988

[51] Int. Cl.[4] ..... B27F 7/00

[52] U.S. Cl. ..... 29/430; 29/432; 29/716; 227/2; 227/76; 227/103; 227/152

[58] Field of Search ..... 29/430, 432, 716; 227/2, 39, 40, 103, 76, 152

[56] References Cited

U.S. PATENT DOCUMENTS

| | | | |
|---|---|---|---|
| 3,564,702 | 2/1971 | Hurn et al. | 227/152 X |
| 3,628,714 | 12/1971 | Offenwanger | 227/7 |
| 3,873,015 | 3/1975 | Whitaker | 227/7 |
| 3,897,620 | 8/1975 | Wright | 29/430 |
| 3,986,247 | 10/1976 | Kellner et al. | 29/430 |
| 4,031,604 | 6/1977 | Jureit et al. | 227/152 X |
| 4,039,112 | 8/1977 | Schultz | 227/40 |
| 4,305,538 | 12/1981 | Schultz | 227/2 |
| 4,403,724 | 9/1983 | Bardenstein | 227/76 |
| 4,620,658 | 11/1986 | Martin | 227/152 |
| 4,793,540 | 12/1988 | Mangan et al. | 29/432 X |
| 4,796,350 | 1/1989 | French | 29/432 |

*Primary Examiner*—Paul A. Bell

*Attorney, Agent, or Firm*—King & Schickli

[57] ABSTRACT

An apparatus is provided for fabricating frame walls from end plates and studs. The apparatus includes a mechanism for the length-wise feeding of the end plates into registration position. An additional mechanism is provided for feeding a stud into registration position between the end plates. A nailer tacks the end plates and stud together in proper registration while maintaining clearance between the end plates for subsequent positioning of another stud in registration. After the positioning and tacking of an additional stud or studs, a staking and anchoring mechanism presses the plates and first stud fully together so as to rigidify the frame walls. As an additional feature of the present invention, the operations of the apparatus are controlled by a microprocessor controller. This controller is programmed to produce wall frames corresponding to each individual wall to be constructed throughout a building. In accordance with another aspect of the present invention a method for the fabrication of frame walls is also provided.

15 Claims, 4 Drawing Sheets

APPARATUS AND METHOD FOR FRAME WALL FABRICATION

TECHNICAL FIELD

The present invention relates generally to the construction field and, more particularly, to an automated device and method for fabricating stud frame walls.

BACKGROUND OF THE INVENTION

For many years the construction of stud frame walls or "framing" of a building has been performed manually. One or more carpenters fasten a plurality of elongate stud members in parallel at spaced intervals between a pair of plate members. The plate members extend horizontally and form the upper and lower margins of the frame wall with the stud members extending vertically between them.

Unfortunately, manual framing is, of course, labor intensive and as such, relatively expensive. In addition, it should be appreciated that there are relatively few carpenters who have developed their skills to the level necessary to consistently produce high quality frame walls. Recognition of these problems has led to the application of mass production techniques to this area of the art. More specifically, automated machinery has been developed to produce prefabricated frame walls at a remote location. The prefabricated frame walls are then shipped to and erected at the building site.

It is also known to fabricate frame walls with automated machinery at the building site. An apparatus and method to achieve this end is described in U.S. Pat. No. 4,305,538 to Schultz, et al. The Schultz, et al. apparatus includes a pair of stud selecting plates to transfer a stud from a rack and position it between the plates of the frame wall. Nailers then securely fasten the stud in position with the ends of the stud engaging the interior faces of the plates. After the plates are advanced, plate spreaders pull the plates apart to allow placement of the next stud between the plates. This procedure continues until each frame wall is completed.

While the apparatus and method disclosed in the Schultz, et al. patent provide for relatively efficient fabrication of frame walls at the building site, they are not without their disadvantages and, thus, can be improved. More specifically, by spreading the plates in order to allow the introduction of the next stud into position, the fastening between the previously nailed stud and plates is loosened. The instability characteristic of the resulting frame wall makes it difficult to handle. In many instances it will also require repair before use. A need is therefore identified for an improved apparatus and method for prefabricating frame walls for installation at a building site.

BREIF SUMMARY OF THE INVENTION

Accordingly, it is a primary object of the present invention to provide an apparatus and method for fabricating stud frame walls overcoming the above-described limitations and disadvantages of the prior art.

It is another object of the present invention to provide a method and apparatus for the convenient and efficient fabrication of stud frame walls at the building site.

Yet another object of the present invention is to provide a method and apparatus for efficiently fabricating frame walls of improved rigidity and stability.

Still another object of the present invention is to provide a method and apparatus for fully automated fabrication of stud frame walls wherein each frame is automatically constructed in accordance with the building plans. This includes provision for the necessary spacing between studs and the necessary double studding for the windows and doorways in each wall.

Still another object of the present invention is to provide a method and apparatus for fully automated fabrication of stud frame walls for the complete framing of the building wherein each frame is marked for ready identification so as to assure proper positioning by the laborers and carpenters during framing.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for fabricating frame walls from end plates and studs. The apparatus includes a mechanism for feeding the end plates lengthwise into a registration position. An additional means is provided for feeding a stud into the registration position between the end plates.

Once in registration, a nailer tacks the end plates and stud together. This tacking serves to temporarily hold the stud in position between the end plates as the end plates are advanced for placement of the next stud. In addition, by tacking rather than anchoring, sufficient clearance is maintained between the end plates to allow simple and efficient positioning of the next stud. Further, this positioning of the next stud is possible without placing undue stress or strain on the joints between the first stud and the end plates.

Only after the positioning and tacking of a subsequent stud between the end plates is the actual anchoring between the end plates and first stud completed. More specifically, a staker fully engages the end plates and stud to stake them fully together and rigidly anchor the stud in position. This approach serves to preserve the integrity of the connection between the stud and end plates. As a result, the frame walls exhibit more stability than has been possible in frame walls fabricated in accordance with prior art apparatus and methods.

More specifically, the end plate feeding mechanism of the apparatus includes a series of reciprocating assemblies, one series at each side of the apparatus for feeding each end plate. Each assembly includes a jaw for gripping the end plate. The jaw is mounted on a carriage which is supported and travels along a guide rail by means of wheels. Three such assemblies are provided at spaced intervals along each side of the apparatus to grip and advance the end plates as required to provide the necessary spacing between the studs. Each of the assemblies is moved in synchronization and driven by means of a stepping motor and lead screw.

Studs for positioning between the end plates are maintained in an easy to load dispensing magazine. The magazine includes an actuator for advancing the entire stack of studs so that the lead stud is positioned within the jaw of a stud feeder assembly at each side of the apparatus. A spring loaded brake a the end of the magazine holds the remaining studs in the magazine as the lead stud is moved by the jaw into registration position.

More particularly, each stud feeder assembly includes a pair of actuators. One of the actuators closes the jaw so as to securely engage the stud. This actuator then lowers the jaw and stud downwardly into position between the end plates. The other actuator then extends the assembly so as to place the stud in registration position. After nailing in position, the stud is released by the jaw and each stud feeder assembly is recycled back into position to receive the next stud from the dispensing magazine.

The apparatus may also be provided with additional features. A plate stop assembly assures proper registration of each plate prior to frame wall fabrication. A plate cut-off saw may be provided for cutting each plate to a desired length. In addition, the apparatus may include a drill for drilling holes in the studs to allow the subsequent passage of electrical wiring and/or plumbing through the frame wall. Further, an ink jet marker may be provided so as to mark the frame walls during fabrication. Of course, any other type of marking system could be utilized. For example, frame wall information could be generated by computer and printed on paper which is then adhered to the frame wall. With any chosen method the idea is to allow simple identification of the particular frame wall by the carpenters and the laborers framing the building.

In accordance with yet another aspect of the present invention, a control means including a microprocessor is provided for controlling the overall operation of the apparatus. The microprocessor may be programmed to produce each frame wall of the building with the positioning of the studs being varied for the presence of doorways and windows and double or triple studding being provided where desired. Advantageously, this allows the fabrication of frame walls for the entire building in a significantly reduced amount of time and at less expense. This is particularly true for certain projects such as townhouses or apartments where a number of identical frame walls are required throughout the building.

In accordance with a further aspect of the invention, a method is provided for fabricating frame walls. The method comprises the steps of feeding first and second end plates into registration position. Next is the positioning of a first stud in registration position between the end plates. Clearance between the end plates for the positioning of a second stud is maintained by simply tacking the first stud in the registration position. Only after the second stud is positioned and tacked in registration is the anchoring of the first stud completed. This is done by staking and anchoring the end plates and first stud fully together.

The method also includes the step of drilling holes in the studs where desired for the subsequent receipt and passage of electrical wiring and/or plumbing. In addition, the method may include the step of marking the frame wall during fabrication so as to allow ready identification by the laborers and carpenters. By reviewing the building plans these individuals can then properly position the frame wall in the building at a subsequent time. Yet another step in the method is the programming of the apparatus to substantially complete the framing of each individual wall throughout the building.

Still other objects of the present invention will become readily apparent to those skilled in this art from the following description wherein there is shown and described the preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawing and description will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
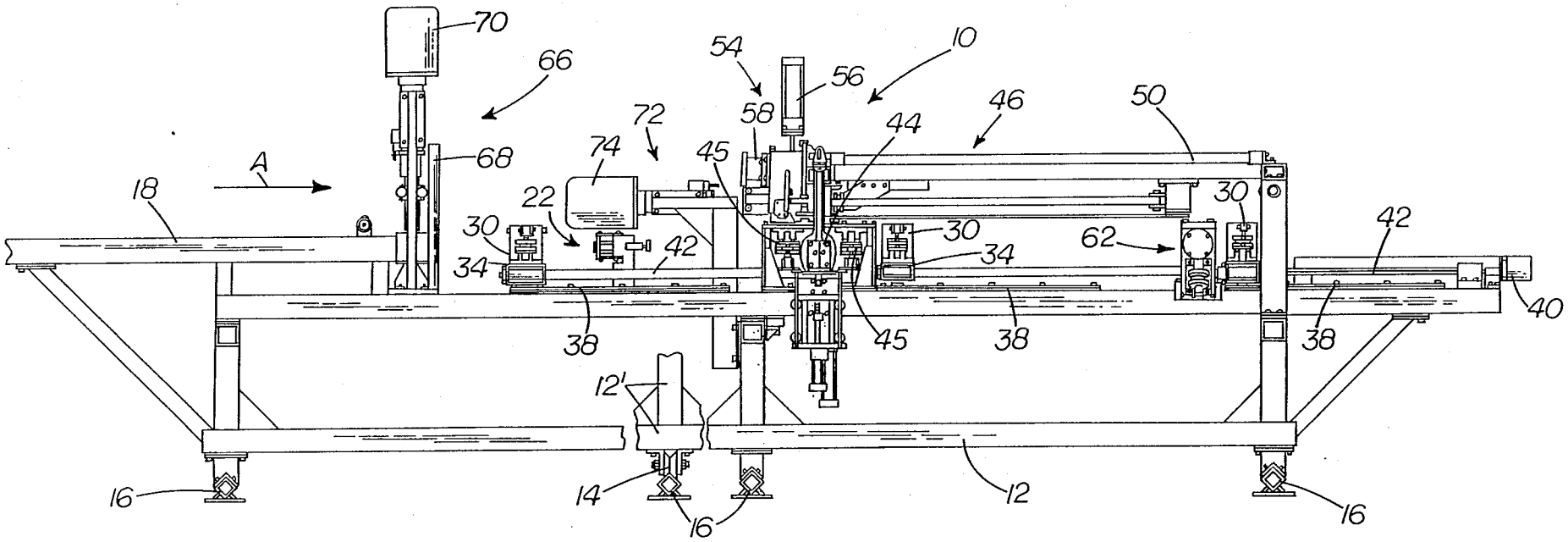
FIG. 1 is a partially cut-away side elevational view of the apparatus of the present invention for fabricating frame walls.
Figure 2:
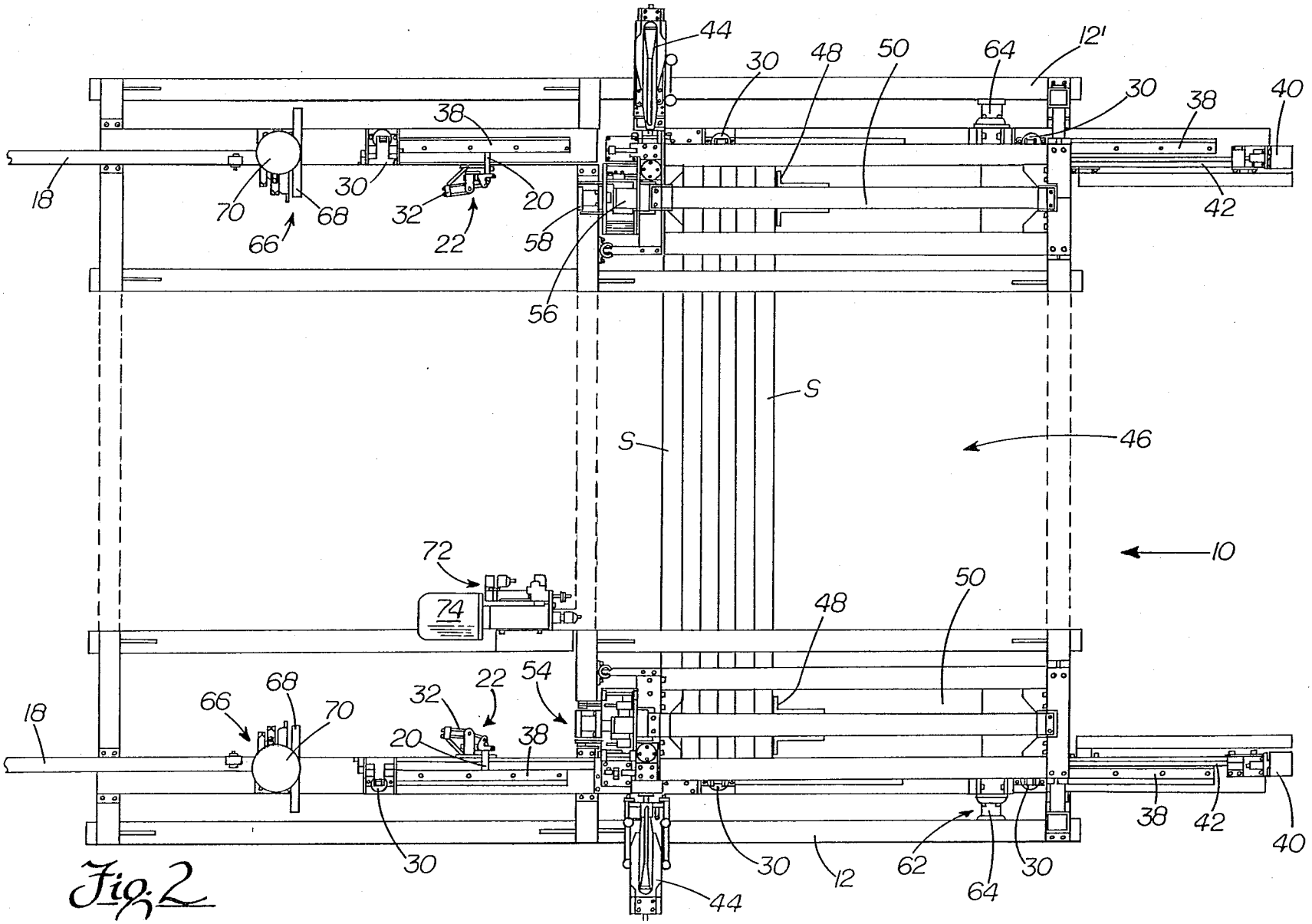
FIG. 2 is a top plan view of the apparatus shown in FIG. 1.

Reference is now made to FIGS. 1 and 2 showing the apparatus 10 of the present invention for fabricating frame walls from end plates P and studs S. As shown, the apparatus 10 includes a frame unit 12, 12' at each side for supporting each end plate P in position during frame wall fabrication. One frame 12', for the upper end plate, is mounted by means of wheels 14 to spaced, underlying rails 16. This allows the frame 12' to be selectively positioned along the rails 16 so that the distance between the frames 12, 12' and, therefore, the height of the frame wall being fabricated may be adjusted to, for example, any height between 6' and 12'. In addition, where the rails 16 are constructed from interlocking segments the overall width of the apparatus may be sufficiently reduced so as to allow the convenient mounting of the apparatus to a truck trailer for transport to and from building sites.

As shown in FIG. 1, a ramp 18 is provided at each side of the apparatus 10 for the receipt of an end plate P. More specifically, the machine operator places a plate P on each ramp 18 and pushes it forward in the direction of action arrow A until the end plate engages the gate 20 of the plate stop assembly 22 (see also FIG. 4). One plate stop assembly 22 is provided along each plate feed path to assure that the plates P are properly positioned in the apparatus to start fabrication of a frame wall.

Figure 4:
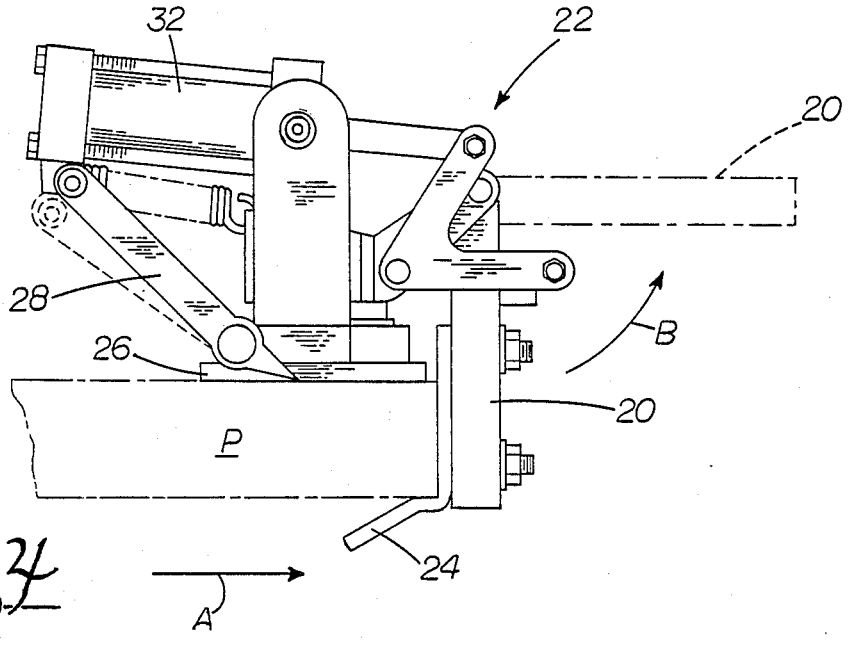
FIG. 4 is a detailed view of the plate stop assembly of the present invention that assures proper positioning of the plates for fabrication of the frame walls.

As shown in FIG. 4, a guide plate 24 engages and guides the end of the plate P into proper position with the side of the plate against the guide rail 26 and the butt end of the plate against the face of the gate 20. A spring loaded knife blade 28 extends into the side of the plate P to assure that the plate doesn't bounce back from the gate 20. A plate stop assembly 22 of the type described is available from DeSta Co. of Troy, Mich.

Once each plate P is in proper position in each plate stop assembly 22, the end plate feeding jaw assemblies 30 are actuated to securely clamp the plates and hold them in position. The cylinder 32 of each plate stop assembly 22 is then activated to pivot the gates 20 open in the direction of action arrow B (see FIG. 4) to the phantom line position. The plates P are then ready to be advanced into registration position so as to allow the nailing of the first stud into position between the plates.

Figure 5:
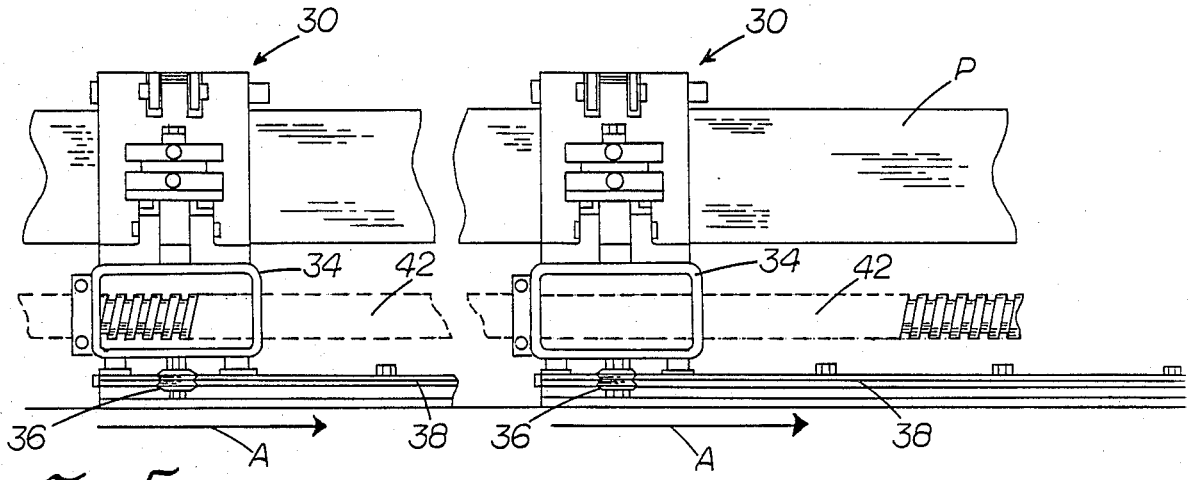
FIG. 5 is a detailed schematical representation of the plate feeding mechanism of the present invention.

More specifically, the plates P are advanced or fed lengthwise into registration position by means of the feeding jaw assemblies 30. Each assembly 30 includes a carriage 34 equipped with opposing wheels 36 (only one shown in FIG. 5) for engaging and traveling along a guide rail 38. Three feeding jaw assemblies 30 are provided in series to feed each plate P during fabrication. Synchronized movement of each of the three feeding jaw assemblies 30 is assured by means of a drive mechanism including a stepping motor 40 and associated lead screw 42. More particularly, a single lead screw 42 extends through a mating threaded opening in the carriage 34 of each assembly 30. The stepping motor 40 drives the lead screw 42 at a particular rate for a particular period of time to advance the jaw assemblies 30 together and thereby each plate P a desired distance equal to the proper spacing between the studs.

More particularly, for placement of the first stud between the plates P the assemblies 30 at each side of the apparatus 10 are advanced a sufficient distance to bring the end of the plates P into a registration position wherein the end margins are aligned with the nailers 44. The stationary plate clamps 45 are then actuated to clamp the plates P in registration position with sufficient clearance being positively maintained between the plates to allow proper positioning of a stud. After this occurs, the jaw assemblies 30 are recycled to the home position (shown in the drawing figures) as described in greater detail below. With the plates P in proper registration, a stud S is fed into position for nailing between the plates.

Figure 3:
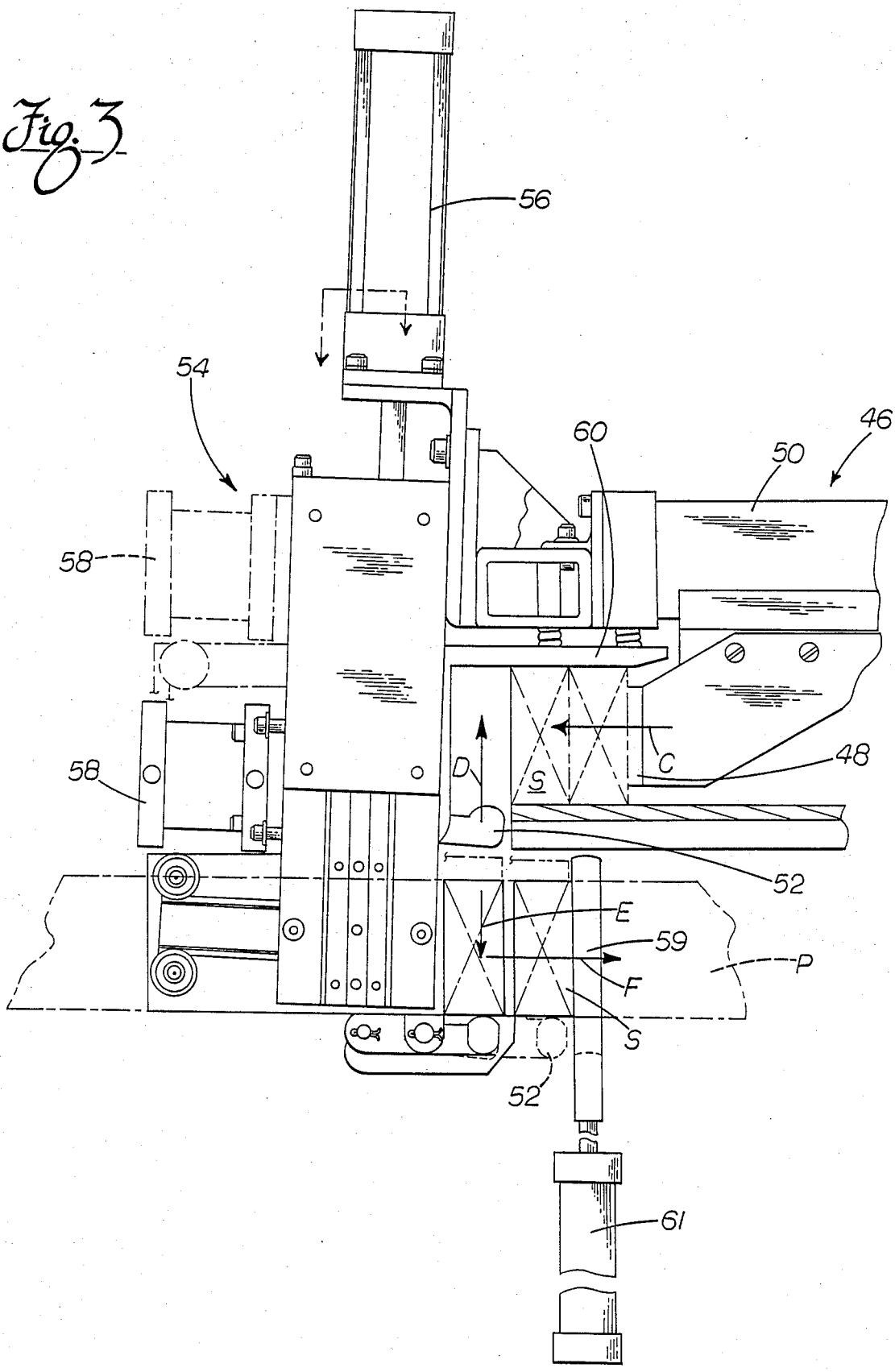
FIG. 3 is a detailed schematic representation showing the feeding of the studs from the dispensing magazine into the registration position for nailing between the end plates.

As best shown in FIGS. 2 and 3, a series of studs S are stored in a dispensing magazine 46 overlying the plate feed path defined by the feeding jaw assemblies 30. A feed plate 48 connected to a rodless cylinder 50 (such as available from Norgren Martonair Company) at each side of the magazine 46 pushes the stack of studs S (note action arrow C) so that the lead stud is delivered from the magazine into the open jaws 52 of the stud feeder assemblies 54. One assembly 54 is located on each side frame 12, 12' of the apparatus 10 (see FIG. 2). This assures that no matter what length of stud is being utilized, it is always delivered without any twisting and with the ends in proper orientation for tacking in position.

Once the stud S is placed in position within the jaws 52, the jaws are closed (see action arrow D) by means of the actuator 56. Further operation of the actuators 56 serves to lower the jaws 52 and actuators 58 in the direction of action arrow E down into position with the stud S extending between the plates P. Since the actuators 56 are mounted at an angle (approximately 2°) with respect to the vertical, the stud S in the jaws 52 is positively pulled away from the studs in the magazine 46. This serves to prevent sticking and thereby reduces the force necessary to move the stud S from the magazine 46. Once the stud S is fully lowered, the actuators 58 are activated to advance the stud S into registration position for nailing (see action arrow F). More specifically, the stud S is advanced until it engages the stop pin 59. This insures that the stud S is properly positioned in registration for nailing. Once the stud S is in registration position, the nailers 44 are activated. As is known in the art, actuators connected to the nailers 44 are activated to bring the trigger on each nailer into contact with the side of a plate. This causes the delivery of a nail through the plate P into the stud S. Nailers 44 of the type being utilized are available from Senco Products, Inc. of Cincinnati, Ohio.

In accordance with an important aspect of the present invention, the nailers 44 are adjusted so that nails are driven through the plates P into the end of the studs so as to tack the stud in position. The necessary play or clearance between the plates P to allow placement of the next stud S in position is, however, positively maintained by the stationary clamps 45. As described above, the clamps 45 hold the end plates P so that there is clearance between the inner surfaces of the end plates and the studs. This clearance is maintained after tacking.

With the provision and maintenance of this clearance, placement of the next stud may be completed without straining and loosening the joint between the end plates and the first stud. In addition, it should be appreciated that two nails are tacked through the end plates P into the end of each stud S. Advantageously, two nails are used in order to prevent the stud S from twisting out of alignment with the plates P as fabrication of the frame wall continues.

Once the stud S is properly tacked in position, the movement of the stud feeder assemblies 54 is reversed. The actuators 56 are activated to open the jaws 52 and release the stud S. The actuators 58 are then activated to retract the jaws 52 away from the stud S. Then actuators 56 are again activated to bring the jaws 52 back into its original position in front of the magazine 46 for receipt of the next stud S. Of course, it should be recognized that the studs S in the magazine 46 are held in the ready position by means of the release of pressure on the cylinders 50 and the spring loaded brakes 60 at the end of the magazine.

After the nailing operation is completed and while the stud feeder assmblies 54 are cycling back into position to receive the next stud from the magazine 46, the jaws of the feeder assemblies 30 are closed to clamp the plates P. The actuators 61 (one mounted adjacent each side of the apparatus 10) are also actuated to lower the stop pins 59 to bring the top of the pins to the dashed line position shown in FIG. 3 (note only the right side pin 59 is shown in the figure). This allows the necessary clearance for the passage of the stud S over the top of the stop pins 59 as the plates P are advanced from left-to-right in FIG. 3.

The stationary plate clamps 45 are released and the end plates P are fed lengthwise by means of the stepper motors 40 as described above, to place them in registration for the nailing of the next stud. For example, where the spacing between the first stud and the next stud is to be on twelve inch centers, the plates P are advanced by the stepping motors 40, lead screws 42 and jaw assemblies 30 twelve inches. The stationary plate clamps 45 are then again activated to hold the plates P in registration position with clearance for positioning of the next stud S. After this occurs, the jaws of the plate feeding assemblies 30 are opened, the stepping motors 40 reversed and the assemblies 30 returned to their home position. During this time, the actuators 61 are activated to raise the stop pins 59 back into the full line position shown in FIG. 3 to allow proper positioning of the next stud S. The next stud S is then fed into position by means of the stud feeder assemblies 54 as described above. Once the next stud S is in position, the nailers 44 are again activated to tack the next stud in position. This is done while maintaining the necessary clearance between the end plates P for subsequent positioning of another stud in registration therebetween.

This process continues as described until the lead or first stud reaches the staking station 62. At the staking station 62 the end plates P and stud S are fully pressed and staked together so as to anchor the stud in position and thereby increase the integrity and soundness of the fabricated frame wall. This staking process is completed by means of opposing rams 64 at each side of the apparatus 10 that serve to press the end plates P and stud S together and fully embed the nails. Each stud S is staked in position in this manner as they are serially advanced to the staking station 62.

The apparatus 10 of the present invention also includes some additional features that add to its overall flexibility, convenience and utility. More specifically, a cut-off saw 66 may be provided at the end of each ramp 18. Each cut-off saw 66 includes a circllar saw blade mounted within a shield 68 and driven by a motor 70 such as a Model M200EHB motor available from Hypneumat, Inc. of Milwaukee, Wis. Each of the cut-off saws 66 is activated when the desired length for each end plate has been advanced past the cut-off mechanism. At that point the saw blade is advanced downwardly to cut the end plates P to the desired length.

As an additional convenience feature, the apparatus 10 is equipped with a drill 72 for drilling openings in the studs S as, for example, for the passage of electrical wiring. As shown, the drill 72 is mounted above the plate feed path in alignment with the studs S as they are positioned in the stud feeder jaws 52 from the magazine 46. When a stud S is positioned in the jaws 52, the motor 74 is activated and the drill 72 is advanced to bore an opening in that stud as desired.

Figure 6:
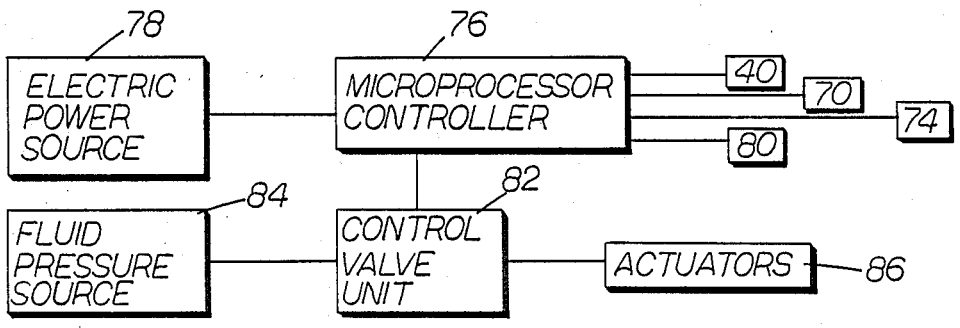
FIG. 6 is a schematic control circuit diagram for the apparatus.

The overall operation of the apparatus of the present invention is controlled by means of a microprocessor controller, shown schematically in FIG. 6 at 76. The microprocessor 76 is connected to an electrical power source 78 and run in accordance with appropriate software to control the overall operation of the various components of the apparatus 10.

More particularly, the blueprints of a particular building are reviewed and the length of each frame wall and the positioning of each stud in that wall is programmed into the microprocessor 76. With this information, the microprocessor 76 directs the operation of the apparatus 10 to produce each wall at the job site with the necessary spacing between studs for, for example, windows and the desired double studding for, for example, doors. A marker or markers 80 (such as produced by Matthews International Corporation under the trademark Jet-A-Mark) may be provided on the apparatus 10 so as to mark each frame for identification. The carpenters and laborers can then compare the identification markings on the frame wall with the plans for the building and place the particular prefabricated wall in the proper position. This marker 80 may, of course, also be used to mark the top, bottom, right or left side of the frame and indicate if an opening is for a door or window in order to further aid in the final construction of the building.

As shown in FIG. 6, the microprocessor controller 76 is connected to a valve control unit 82. The valve control unit 82 controls the delivery of pressurized fluid from the pressurized fluid source 84 to the various actuators of the apparatus 10 generally designated by the reference numeral 86 in FIG. 6. These actuators 86 include, for example the plate stop assembly actuators 32, dispensing cylinders 50, the stud feeder actuators 56, 58, the stop pin actuators 61, the actuators that control the operation of the jaws of the stationary plate clamps 45, and the plate feeder assemblies 30 as well as the positioning of the nailers 44 and the staking operation of the rams 64. The microprocessor controller 76 also controls the power supply to motors 40, 70 and 74 and the markers 80 as well as the other electrical operations of the apparatus 10.

Briefly summarizing, the apparatus 10 provides smooth and efficient operation while rapidly producing frame walls of maximum structural integrity. The plates P are initially positioned on the ramps 18 and pushed forward into proper loading position against the gates 20. The plate feeder assemblies 30 then clamp the plates P and are cycled to move the end margins of the plates into registration position. There, the plates P are grasped by the stationary clamps 45 and held in position to provide clearance for the positioning of a stud while the assemblies 30 are reciprocated back to the home position. A stud S is fed during this time from the dispensing magazine 46 to the stud feeder assemblies 54 that position the stud S in registration for tacking. The nailers 44 are activated to tack the stud S in position between the plates P. Advantageously, tacking serves to hold the stud S in position while maintaining the necessary clearance between the plates P to allow the positioning of subsequent studs therebetween.

Once the first stud is tacked in position, the stationary clamps 45 are released and the plate feeder assemblies 30 are again cycled to advance the plates a distance equal to the desired spacing between the studs. Once so advanced, the stationary clamps 45 are again activated to hold the plates in position. The next stud is then delivered from the dispensing magazine 46 to the jaws 52 of the stud feeder assemblies 54. If desired, the drill 72 is activated to bore a hole in the stud for the subsequent passage of electrical wiring or plumbing. Thereafter the stud is delivered into the registration position and tacked by the nailers 44. This procedure continues until the first stud reaches the staking station 62. At the staking station 62, the first stud is fully staked or anchored to the end plates so as to rigidify the frame wall.

The plates P are also cut to the desired length for the particular wall in question by means of the cut-off saws 66. Advantageously, by programming the microprocessor controller 76, each individual wall of an entire building may be constructed using the apparatus 10 of the present invention with the necessary openings for doors and windows and any desired double and triple studding.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A method for fabricating a frame wall with a framing apparatus, comprising the steps of:

feeding first and second end plates into registration position;

positioning a first stud in registration position between said end plates;

tacking said first stud in registration position while maintaining clearance between said end plates for positioning of a second stud in registration between said end plates; and staking and anchoring said end plates and first stud fully together only after said second stud is in registration; whereby the necessary clearance is provided between said end plates to allow proper and efficient positioning of said second stud while application of pressure tending to pull said end plates and first stud apart in order to position said second stud in registration is substantially eliminated.

2. The method set forth in claim 1, including the additional step of drilling holes in said studs for subsequent receipt and passage of electrical wiring and plumbing.

3. The method set forth in claim 1, including the additional step of marking said frame wall during fabrication so as to allow subsequent identification.

4. The method set forth in claim 1, including the additional step of programming said framing apparatus to substantially complete the framing of each individual wall throughout a building.

5. An apparatus for fabricating frame walls from end plates and studs, comprising:

means for lengthwise feeding of said end plates into registration position;

means for positively maintaining clearance between the end plates for positioning of a stud;

means for feeding a stud into registration position between said end plates;

nailer means for tacking said end plates and studs together in proper registration while maintaining clearance between said end plates for subsequent positioning of another stud in registration therebetween; and means for staking and anchoring said end plates and studs fully together only after another stud has been positioned in proper registration between said end plates whereby proper and efficient positioning of said studs and maximum integrity and soundness of said fabricated frame walls are assured.

6. The apparatus of claim 5, further including means for dispensing said studs to said stud feeding means.

7. The apparatus set forth in claim 6, wherein said stud dispensing means includes a stud magazine, an actuator for advancing said studs in said magazine and brake means for positively holding said studs in position in the magazine.

8. The apparatus of claim 5, further including control means for controlling operation of said end plate feeding means, stud feeding means, nailer means and staking and anchoring means so as to allow fabrication of a frame wall with openings for windows and doorways and double and triple studding where desired for fabrication of a building in accordance with design plans.

9. The apparatus of claim 5, further including plate cut-off means.

10. The apparatus of claim 5, further including means for drilling holes in said studs for subsequent passage of electrical wiring and plumbing.

11. The apparatus set forth in claim 5, further including means for marking said frame wall during fabrication so as to allow subsequent identification.

12. The apparatus set forth in claim 5, wherein said end plate feeding means includes jaw means for gripping said end plates, carriage means upon which said jaw means is mounted, a guide rail for supporting said carriage means and drive means for driving said carriage means in a reciprocating manner.

13. The apparatus set forth in claim 12, wherein said drive means is a stepping motor and lead screw.

14. The apparatus set forth in claim 15, further including a plate stop assembly for properly aligning the plates prior to fabrication of the frame wall.

15. The apparatus set forth in claim 5, wherein said stud feeding means includes jaw means for gripping said studs and actuator means for operation of said jaw means and for moving said stud into registration position.

* * * * *